United States Patent [19]

Hintz

[11] Patent Number: 4,475,691

[45] Date of Patent: Oct. 9, 1984

[54] FLUID FLOW DIRECTIONAL DEVICE

[75] Inventor: Curtis M. Hintz, Cottage Grove, Minn.

[73] Assignee: South Park Corporation, South St. Paul, Minn.

[21] Appl. No.: 444,082

[22] Filed: Nov. 24, 1982

[51] Int. Cl.[3] ..... B05B 15/08

[52] U.S. Cl. ..... 239/587

[58] Field of Search ..... 239/451, 499, 502, 522, 239/476, 500, 521, 587; 137/272; 251/154, 155; 138/46

[56] References Cited

U.S. PATENT DOCUMENTS

| | | | |
|---|---|---|---|
| 497,480 | 5/1893 | Thies | 239/446 |
| 539,661 | 5/1895 | Bastam | 239/451 |
| 591,120 | 10/1897 | Sherman | 239/587 X |
| 873,826 | 2/1905 | Dinkel | 239/523 |
| 2,087,139 | 7/1937 | Cameron | 251/155 X |
| 2,297,239 | 9/1942 | Neugebauer et al. | 60/35.6 |
| 2,775,485 | 12/1956 | Miller | 299/121 |
| 2,869,927 | 1/1959 | Ayers | 239/523 |
| 3,144,211 | 8/1964 | Goldman | 239/532 |
| 3,291,195 | 12/1966 | McIntosh et al. | 239/522 X |
| 4,073,439 | 2/1978 | Grataloup | 239/655 |
| 4,244,556 | 1/1981 | Miller | 251/154 X |
| 4,320,072 | 3/1982 | Arndt | 261/111 |

FOREIGN PATENT DOCUMENTS

| | | | |
|---|---|---|---|
| 726883 | 6/1932 | France | 251/154 |
| 0482877 | 4/1938 | United Kingdom | 239/587 |

*Primary Examiner*—John J. Love
*Assistant Examiner*—Mary F. McCarthy
*Attorney, Agent, or Firm*—Merchant, Gould, Smith, Edell, Welter & Schmidt

[57] ABSTRACT

A device (16) for diverting and diffusing flushing water from a source such as a hydrant (10) includes a swivel (46) attachable to a spout (12) of a hydrant (10) and a discharge member (18) carried by the swivel (46) for rotation about a first axis (30). The discharge member (18) has a first portion (26) aligned with the first axis (30) and a second portion (28) aligned along a second axis (32) which intersects the first axis (30) at an acute angle. As the discharge member (18) is rotated about the first axis (30) within the swivel (46), the direction of the discharge of liquid through an internal passageway (22) formed in the member (18) will vary.

2 Claims, 4 Drawing Figures

FIG. 1
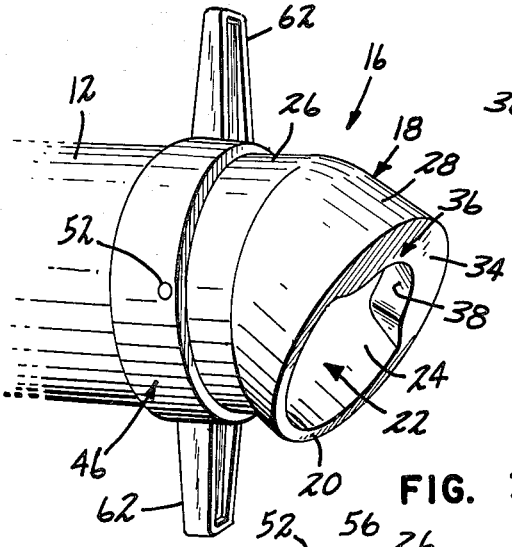
FIG. 2
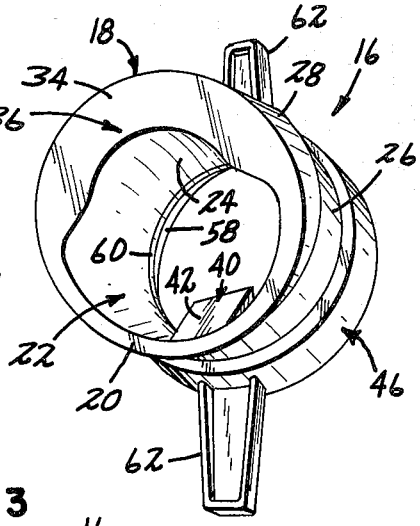
FIG. 3
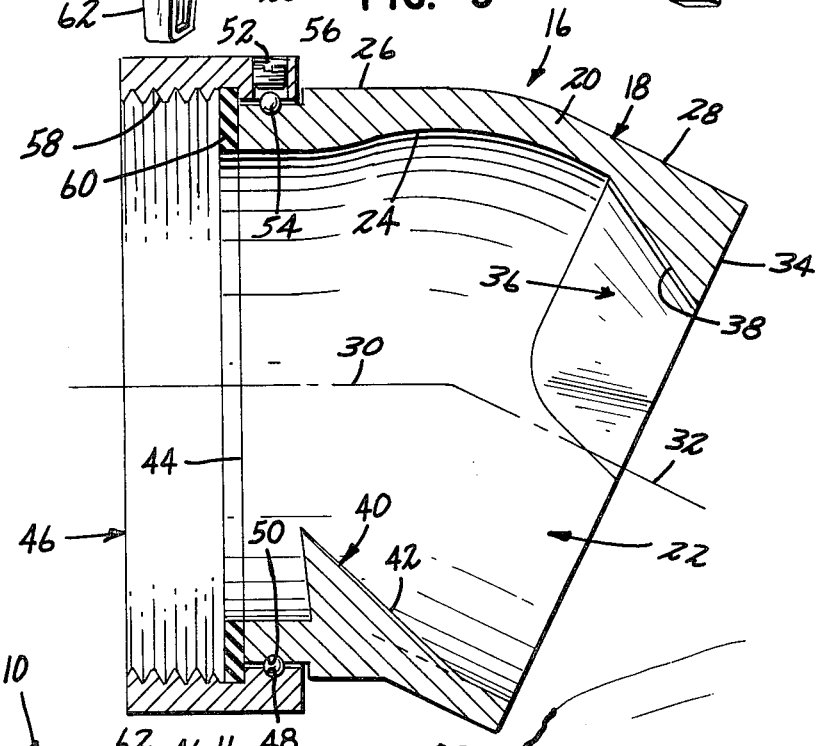
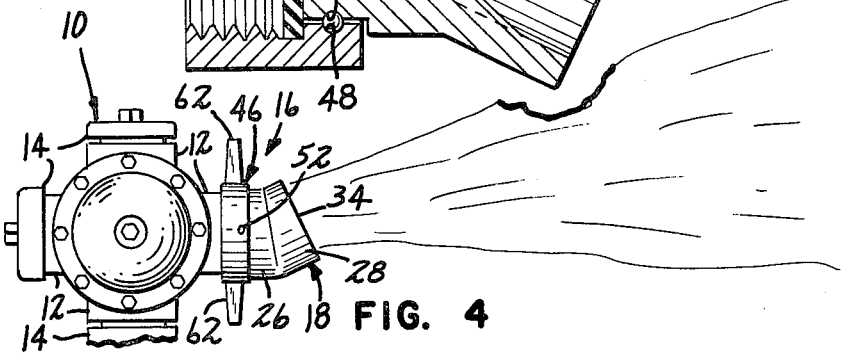
FIG. 4

FLUID FLOW DIRECTIONAL DEVICE

TECHNICAL FIELD

The invention of the present application deals broadly with apparatus for directing the flow of fluid from a source at which it is maintained under pressure. A specific application of the invention is directed to a device for directing and redirecting liquid flow from structures such as fire hydrants. In a preferred embodiment, the invention relates to a device for not only directing fire hydrant flushing water, but also for diffusing the liquid stream so as to attenuate the force with which the stream will strike objects coming within its path.

BACKGROUND OF THE INVENTION

Various types of mechanisms exist wherein fluid, under pressure, is discharged through an orifice or port. Although the invention of the present application is equally as applicable for use with any of such structures, a particularly important application is one wherein it is attached to a conventional water main hydrant.

It is a typical practice of water departments to flush water mains and hydrants at least annually. Hydrant valves are opened to a "full open" position so that maximum fluid flow will be allowed in order to achieve maximum efficiency of the process.

Fire main hydrants can be mounted in various locations, but, typically, they are most frequently positioned along street curbs in areas where access thereto will likely be necessary. In many instances, these locations are in residential neighborhoods.

Because of the construction of such fire main hydrants, when they are flushed they typically produce a water discharge having high energy and exerting significant force upon any object which might come into its path. Typically, the water flow generated during hydrant flushing is in a fixed direction, the direction of discharge not being able to be varied. As can be seen, therefore, hydrant flushing can pose a not insignificant safety problem. This is especially true in view of the frequent presence of such hydrants in residential neighborhoods where children can be found. It is not unrealistic to expect that injuries could readily occur as a result of a city's annual flushing program.

Various structures in the prior art have attempted to solve these problems. U.S. Pat. No. 783,826 (Dinkel) provides an open sprinkler which has a deflector. U.S. Pat. No. 2,775,485 (Miller) discloses an automobile washing sprinkler having a deflector. The water passed through that system impinges upon the deflector as it leaves the nozzle.

U.S. Pat. No. 2,869,927 (Ayers) teaches a down spout drain that includes a lip bent inwardly and curved laterally in a direction of the curve of the tube. Additionally, various other structures have attempted to solve the prior art problems.

No structure, however, solves all the existing problems. None of the prior art of which Applicant is aware anticipates the numerous deficiencies which are encountered with typically fire main hydrants.

The invention of the present application, however, incorporates certain features which solve the problems discussed above. It is a device which not only allows the stream of water from a fire main hydrant to be directed in a safe direction, but it also diffuses the water flow in order to reduce the force of the stream which is applied to an object which might come into its path.

SUMMARY OF THE INVENTION

The invention of the present application is a device by which fluid from a source such as a fire main hydrant can be directed in a desired direction. The apparatus includes a discharge member which has an internal passageway formed therein. The passageway is defined by an enclosing side wall having an inwardly facing surface. The passageway has a first portion which is aligned along a first axis. Similarly, the passageway has a second portion aligned along a second axis. The second axis intersects the first axis at an acute angle, the orientations of the first and second axes together defining an intended direction of flow through the internal passageway. The apparatus further includes means by which the discharge member can be positioned relative to the source of the fluid so that fluid is channeled into the internal passageway.

The apparatus can further include a swivel which carries the discharge member. The swivel can be attached to a spout of a fluid source such a a fire main hydrant so that the discharge member is disposed for rotation about the first axis. As the member is rotated about the first axis, therefore, liquid passing from the source into the internal passageway can be directed in varying directions depending upon the orientation of the second portion of the passageway.

In a preferred embodiment, a distal end of the discharge member can have a bead built up in the internal passageway. The bead can be formed on a side of the inwardly facing surface of the enclosing side wall of the member which is away from a direction in which the second axis with which the second portion of the passageway is aligned diverges from the first axis along which the first portion of the passageway is aligned. Diversion of the fluid stream is, thereby, further facilitated.

A preferred structure of the invention can include a diffusion block positioned in the internal passageway. Such a block can be positioned on the inwardly facing surface of the enclosing side wall on a side thereof in the direction in which the second axis diverges from the first axis and proximate the intersection of the first portion of the member with the second portion thereof. The block can have a cross-sectional shape in a plane generally normal to an intended direction of movement of fluid through the passageway which is substantially rectangular. A down flow surface of the block can be tapered downwardly toward the inwardly facing surface of the second portion of the discharge member so that this ramp-like surface merges smoothly with the internal surface of the discharge member side wall. Such a block can function to diffuse the stream of fluid and to reduce the force of the stream below that which it would have absent the block.

The invention of the present application is, thus, an improved device for directing the flow of fluid. More specific features and advantages obtained in view of those features will become apparent with reference to the detailed description of the invention, appended claims, and accompanying drawing figures.

BRIEF DESCRIPTION OF THE DRAWING

FIG. 1 is a perspective view illustrating an orientation of a directing device in accordance with the present application wherein fluid would be directed generally downwardly;

FIG. 2 is a perspective view of the device of FIG. 1 illustrating more clearly a diffusion block carried within an internal passageway of the structure;

FIG. 3 is a side sectional view of the structure of FIG. 1; and

FIG. 4 is a side elevational view of the device of FIG. 1 as attached to a typical fire hydrant apparatus, wherein flow of flushing water is directed upwardly.

DETAILED DESCRIPTION OF THE INVENTION

Referring now to the drawing wherein like reference numerals denote like elements throughout the several views, FIG. 4 illustrates one type of fire main hydrant 10 typically in use in cities and towns throughout the United States of America. The hydrant 10 includes a number of spouts 12 from which pressurized fire main water can be tapped for use in fighting fires. Each spout 12 has a cover 14 which is in place when water is not to be drawn from the hydrant 10. When the need arises for water from the hydrant 10, one or more of these plates 14 are removed and replaced with a fitting which can be of the type of the invention in accordance with the present application.

As seen in FIG. 4, a hydrant flushing device 16 is secured to the rightmost spout 12 of the hydrant 10. As will be described hereinafter, because of the structure of the invention, water can be diverted in any direction about a longitudinal axis of the spout 12. As seen in FIG. 4, however, a water stream is being directed upwardly.

Referring now to FIGS. 1 through 3, the flushing apparatus 16 is more specifically illustrated. The apparatus 16 includes a discharge member 18 structured as an elbow fitting. A side wall 20 of the member 18 encloses an internal passageway 22 therein, the passageway 22 being defined, specifically, by an inwardly facing surface 24 of the enclosing side wall 20.

The member 18 and, in turn, the internal passageway 22 have first and second portions 26, 28. The first portion 26 is aligned along a first axis 30, and, similarly, the second portion 28 is aligned along a second axis 32. The axis 32 of the second portion 28 is disposed at an angle with respect to the axis 30 of the first portion 26. The angle between the axes 30, 32 is acute and, as seen in the drawing, can be approximately 30°.

When the device 16 is attached to a hydrant 10 in a manner that will be described hereinafter, the first portion 26 of the discharge member 18 communicates directly with a spout 12 of the hydrant 10. The path defined by the first and second axes 30, 32 is a path to which water exiting the hydrant 10 will substantially conform. That is, as water is discharged from the hydrant 10 through a spout 12 or discharge port, it will enter the first portion 26 of the discharge member 18 along the first axis 30. As the enclosing side wall 20 of the member 18 diverges to be substantially aligned with the second axis 32, water passing through the internal passageway 22 will, similarly, diverge from the path defined by the first axis 30.

In order to further augment diversion of liquid passing through the discharge member 18, the second portion 28 of the member 18 can be provided, at a distal end 34 thereof, with a bead 36 built up within the internal passageway 22 on the inwardly facing surface 24. With embodiments providing such a bead 36, the bead 36 is formed on a side of the enclosing wall 20 opposite the direction in which the second axis 32 diverges from the first axis 30. Such structuring is necessary in order to accomplish the goal of diversion augmentation. As seen in FIG. 3, the bead 36 can be provided with a ramp surface 38 which diverges smoothly from the inwardly facing surface 24 of the enclosing side wall 20. The change in direction which will be facilitated by the provision of the bead 36 will, therefore, occur somewhat smoothly. As seen in FIGS. 1 and 2, the bead 36 can be made to extend about approximately 180° of the internal passageway 22.

As best seen in FIG. 3, the discharge member 18 can be provided with a diffusion block 40 located in the internal passageway 22. This block 40 functions to create turbulence in the liquid flow and to cause cavitation of the water or other liquid passing through the internal passageway 22. The creation of the turbulence by breaking of the flow of the water stream will tend to reduce the force of the stream discharging through the distal end 34 of the second portion 28 of the discharge member 18.

As best seen in FIG. 3, a down-flow side of the diffusion block 40 is provided with a ramp surface 42 which smoothly merges with the inwardly facing surface 24 of the member. The block 40 can have a generally rectangular cross-section in a plane normal to the intended direction of fluid flow. It has been found that, by so structuring the block 40 and by positioning the block 40 substantially diametrically opposite the center of the bead 36 (as seen in FIG. 2), best redirection and diffusion of the water stream can be accomplished.

The discharge member 18 can be structured in an additional manner in order to further facilitate diffusion. The cross-sectional area of the internal passageway 22 as it exits at the distal end 34 of the second portion 28 of the discharge member 18 can be made greater than the cross-sectional area at the inlet end 44 of the first portion 26 of the member 18. As the cross-sectional area of the passageway 22 expands, the water or other liquid passing through the internal passageway 22 will tend to further diffuse and decrease in velocity.

The discharge member 18 can be mounted to a spout 12 of the hydrant 10 by means of a swivel 46. The member 18 can have an outer diameter at its inlet end 44 similar to the inside diameter of the swivel 46 so that the member 18 can be received therewithin. The portion of the discharge member 18 received within the swivel 46 can be provided with an annular recess 48 in its outer surface. Similarly, an annular recess 50 can be provided in the inwardly facing surface of the swivel 46 so as to register with the recess 48 in the member 18. An aperture 52 extending radially through the swivel 46 and communicating with the annular recess 50 formed therein can be provided for insertion of a multiplicity of bearings 54 into the registered recesses 48, 50. Insertion of a sufficient number of bearings 54 will preclude axial withdrawal of the discharge member 18 from the swivel 46 even when fluid pressure to which the assembly is exposed is high. A set screw type element 56 can be threaded into the aperture 52 through which the bearings 54 are inserted in order to preclude their inadvertent removal.

The swivel 46 can be provided, along a portion of its internal axial length with threads 58 for mating. These threads 58 would, of course, be given a pitch so that they could readily mate with conventional threading on spouts 12 of fire main hydrants 10.

A gasket 60 can be provided within the central opening through the swivel 46 to axially engage the inlet end 44 of the discharge member 18. The outer periphery of the gasket 60 would sealingly engage the inner surface of the swivel 46 in order to preclude leakage of the liquid through the interface between the member 18 and the swivel 46.

When it is necessary to flush a hydrant 10, a spout cover 14 can be removed and a hydrant flushing device 16 in accordance with the present application be attached in its place. The swivel 46 of such a device 16 can be threaded onto the spout 12 until the swivel 46 is tightly secured thereto. A plurality of manually graspable lugs 62 can be attached to the swivel 46 for this purpose. As seen in FIGS. 1 and 2, two of such lugs 62 extend radially outwardly from the swivel 46 at 180° from one another.

The discharge member 18 can be rotated within the swivel 46 and about the first axis 30 in order to select the direction in which water flushed will be deflected. When a valve controlling flow of water through the spout 12 is opened, water will pass into the internal passageway 22 defined by the discharge member 18, be diffused by the block 40, and will be redirected in a desired direction because of the divergence of the second axis 32 from the first axis 30 and the commensurate bend in the wall 20 of the member 18.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined by the language in which the appended claims are expressed.

What is claimed is:

1. A hydrant flushing discharge device, comprising:

(a) a member having formed therein an internal passageway having a first portion aligned along a first axis and a second portion aligned along a second axis intersecting said first axis at an acute angle, said member being matable with the hydrant with a discharge port of the hydrant in fluid communication with said internal passageway;

(b) a diffusion block carried by said member and positioned within said internal passageway at a sidewall thereof on a side toward a direction in which said second axis diverges from said first axis, and proximate an intersection of said first and second portions, to cause turbulence of water passing through said internal passageway; and (c) a bead built up in said internal passageway at a distal end of said second portion on a side of said sidewall away from a direction in which said second axis diverges from said first axis;

(d) wherein water passing through said internal passageway can be both diffused and redirected.

2. A device in accordance with claim 1 further comprising a swivel carrying said member, said swivel being attachable to the hydrant so that water from the hydrant passes into said first portion of said internal passageway.

* * * * *